United States Patent [19]

Gueret

[11] Patent Number: 4,773,562

[45] Date of Patent: Sep. 27, 1988

[54] DISPENSER HEAD FOR MIXING SEPARATE PASTY SUBSTANCES AND A STORAGE UNIT PROVIDED WITH SUCH A DISPENSER HEAD

[75] Inventor: Jean-Louis H. Gueret, Paris, France

[73] Assignee: L'Oreal, Paris, France

[21] Appl. No.: 89,163

[22] Filed: Aug. 25, 1987

[30] Foreign Application Priority Data

Sep. 4, 1986 [FR] France ..... 86 12415

[51] Int. Cl.[4] ..... B05B 7/04; B65D 81/32

[52] U.S. Cl. ..... 222/135; 222/145; 222/183; 239/304; 239/414; 239/600

[58] Field of Search ..... 222/131, 94, 135, 136, 222/145, 148, 402.18, 183, 387, 256–260, 340, 341, 383, 386, 385; 239/104, 106, 303, 304, 306–308, 432, 600, 414

[56] References Cited

U.S. PATENT DOCUMENTS

| | | | |
|---|---|---|---|
| 2,941,696 | 6/1960 | Homm | 222/145 X |
| 3,236,457 | 2/1966 | Kennedy et al. | 239/304 |
| 3,300,095 | 1/1967 | Marraffino | 239/304 X |
| 3,303,970 | 2/1967 | Breslau et al. | 239/304 X |
| 3,416,709 | 12/1968 | Shultz et al. | 222/145 X |
| 3,451,593 | 6/1969 | Dillarstone | 222/145 X |
| 3,521,792 | 7/1970 | Davidson | 222/136 |
| 3,575,319 | 4/1971 | Safianoff | 222/145 X |
| 3,693,837 | 9/1972 | Yuhas | 222/136 X |
| 3,760,986 | 9/1973 | Castner et al. | 222/145 X |
| 4,253,609 | 3/1981 | Laauwe | 239/600 X |
| 4,511,068 | 4/1985 | Bossina | 222/387 X |
| 4,546,922 | 10/1985 | Thometz | 239/304 |
| 4,687,663 | 8/1987 | Schaeffer | 222/94 X |

FOREIGN PATENT DOCUMENTS

| | | | |
|---|---|---|---|
| 1413164 | 8/1965 | France . | |
| 1909163 | 9/1970 | Fed. Rep. of Germany | 222/402.18 |
| 2644780 | 4/1978 | Fed. Rep. of Germany | 222/136 |
| 399350 | 3/1966 | Switzerland . | |

*Primary Examiner*—Kevin P. Shaver

*Attorney, Agent, or Firm*—Cushman, Darby & Cushman

[57] ABSTRACT

A dispenser head (104) is fitted on two separate reservoirs which are disposed side-by-side and on the outlet openings whereof, dispenser valves are disposed. The head (104) comprises a first part (113) which cooperates simultaneously with the two valves with a view to producing the ejection of each one of the constituents into an ejection duct which passes through it. The second part of the head is complementary to the first part so as to constitute in the assembled position of the two parts, a mixing chamber (134) into which there open the two ducts (121*a*, 121*b*). The mixing chamber opens out to the outside of the head. Deflectors (136) may be carried by one of the parts (113, 114) in the mixing region of the chamber (134) to improve the mixing of the material dispensed from the two reservoirs.

14 Claims, 2 Drawing Sheets

204
VI
221a
213
250
249
207a
245
246
238a
247a
202a
239
237a
240
241
252
231
215
214
251
234
253
242
243
290
221b
219
207b
238b
244
247b
202b
237b
VI
114
160
135a
115
121a
113
119
123a
132
131
136
134
135b
121b
122
123b
123
125
103

114
104
113
119
125
103

256
221a
255
225
236
221b
254
256
234
V
V

DISPENSER HEAD FOR MIXING SEPARATE PASTY SUBSTANCES AND A STORAGE UNIT PROVIDED WITH SUCH A DISPENSER HEAD

The present invention relates to a dispenser head for a product with a pasty or viscous consistency resulting from the mixture of two constituents coming from two separate reservoirs. The present invention also relates to a storage unit provided with such a dispenser head.

The products capable of being dispensed from reservoirs similar to those used in such a unit are currently cosmetic products and maintenance products. In the sphere of body care and hair care one may cite, for example, the storage of foam shaving creams, shampoos and depilatory creams in pressurised cans. The present invention, while especially relevant to the dispensing of cosmetic products, is in no way restricted to this particular sphere.

When one wishes to dispense doses of products with two constituents which should only be mixed at the time they are used and which are stored in reservoirs of this type, one may envisage using a dispenser head common to the two reservoirs.

However, this dispenser head must comprise internally a mixing and ejection circuit composed of two feeder tubes whereof each is connected to the ejection duct of the associated reservoir and a single outlet tube over the length of which means must be provided to ensure the mixing of the two constituents. These means may comprise baffles or deflectors opposing the direct ejection path of the product and thus allowing a longer contact time between the two constituents.

It is quite impossible to obtain such a dispenser head by the moulding of a single component whose ducts and baffles are undercut.

Moreover, since this dispenser head must receive substances which by definition have a short life when they are in contact with each other, one must be able to clean it easily after each use.

The present invention provides a solution for this two-fold problem and proposes for this purpose a dispenser head made of two parts, the one being cooperable with the outlet of the two reservoirs and the other being capable of being fitted on the one, each of these parts comprising a fully open portion of the above-mentioned circuit which renders it perfectly mouldable in one operation; when the two parts are fitted on each other, the mixing and ejection circuit is entirely reconstituted. Cleaning of this dispenser head is effected very simply by separating the two parts which constitute the said dispenser head.

The object of the present invention is therefore a new industrial product constituted by a head for dispensing doses of a product of a pasty or viscous consistency resulting from the mixing, also accomplished by the said head, of two constituents stored in separate reservoirs disposed side-by-side, a dispensing element being disposed on the outlet opening of each reservoir.

According to the invention there is provided a head for dispensing doses of a product of a pasty or viscous consistency resulting from the mixing in the head of two constituents stored in separate side-by-side reservoirs each provided with a dispensing outlet element, said head being comprised of two parts fitted to each other, a first of said parts being provided with means adapted to cooperate simultaneously with the two dispensing outlet elements for causing the ejection of the contents of the reservoirs into respective ejection ducts passing through said first part to a mixing chamber defined in part by the first part and in part by the second part, the chamber being defined by complementary means carried by the first and second parts in the assembled position of the two parts, the said chamber having a single outlet opening for the dispensing of a mixture of the material admitted to the chamber from the two ducts.

In accordance with a preferred mode of embodiment, the above-mentioned chamber includes means to delimit a sinuous or zigzag path of the flow resulting from the mixture of the flows of the two individual constituents between the meeting point of these flows in the chamber and the outlet opening of the said chamber. Preferably the sinuous or zigzag path of the resultant flow is obtained by at least one deflector carried by at least one of the parts which constitute the said dispenser head.

The mixing chamber preferably is shaped to provide an identical path for the two flows from the inlet ducts to their meeting point. For instance, the mixing chamber may be Y-shaped, the openings wherewith the said ejection ducts open out into the said chamber being each disposed near the ends of respective ones of the two lateral arms of the Y and the said chamber opening out towards the outside via the free end of the median arm of the Y.

One may also envisage that the mixing chamber may have a channel shape connected at one side at the ends thereof to said ducts and having at the mid-point of the opposite side a median outlet section opening to the exterior of the head.

In a particular mode of embodiment, the mixing chamber is delimited by two opposite walls each appertaining to one of the two parts constituting the head and by a continuous rib carried by one of the two walls, the said rib being received, in the assembled position of the above-mentioned two parts, in a groove which is carried by the opposite wall and whose internal contour corresponds to the external contour of the said rib.

Provision may advantageously be made for the two parts constituting the dispenser head according to the invention to be articulated to each other by an integral or film hinge.

Moreover, according to other preferred characteristics of the dispenser head, the outlet end of the chamber constitutes a projecting dispensing spout; the first part comprises a peripheral guidance skirt capable of sliding around the sub-assembly constituted by the two reservoirs, possibly accommodated in a common shell.

The object of the present invention is also a storage unit allowing a product of a pasty or viscous consistency to be dispensed, which results from the mixing of two constituents stored in separate reservoirs disposed side-by-side, a dispensing element being disposed on the outlet opening of each of the reservoirs, the unit being equipped with a dispenser head such as defined above.

The reservoirs are chosen from the group formed by pressurised containers of the "aerosol can" type, the containers comprising a manual ejection pump and piston dispensers equipped in their upper portion with a non-return valve and in their lower portion with a follower piston. In the case where the reservoirs are piston dispensers whose outlets are constituted by tubes, the said tubes cooperate with the ejection ducts and comprise catch engagement means complementary to the means carried by the said ejection ducts.

The dispensing valves can be of the emergent stem type. In that case, the reservoirs can be accommodated in a common shell, the first part of the head comprising two recesses receiving the ends of the stems of the dispensing valves which cooperate with the ejection ducts.

To render the present invention more readily understood there will now be described several modes of embodiment represented in the accompanying drawings by way of purely illustrative and non-restrictive examples.

Figure 2:
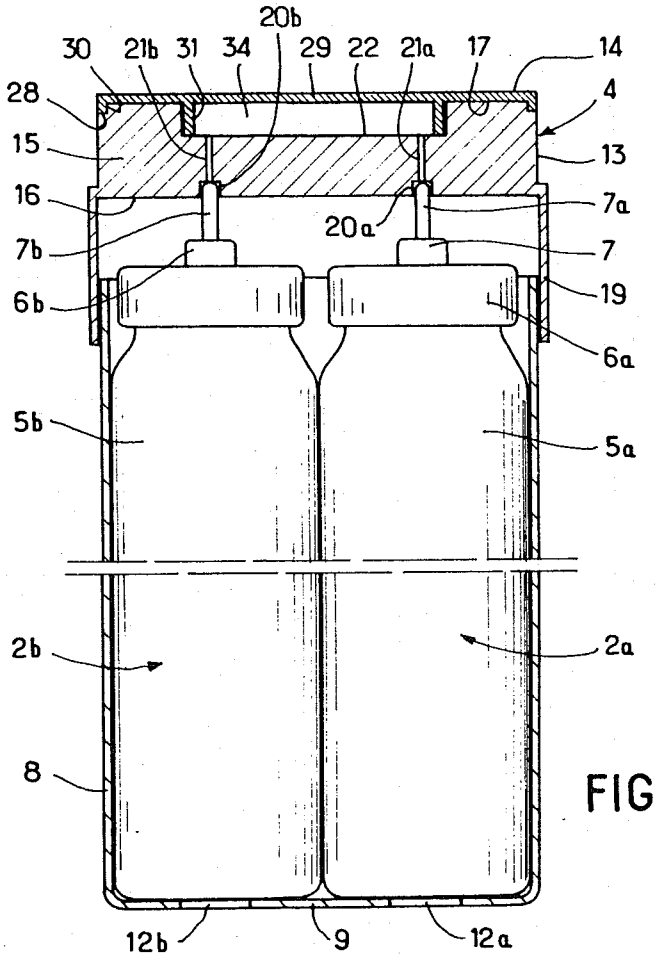
FIG. 2 is an axial cross-sectional view of the unit of FIG. 1, along II—II of FIG. 1, the two pressurised containers, however, being represented in elevation.
Figure 1:
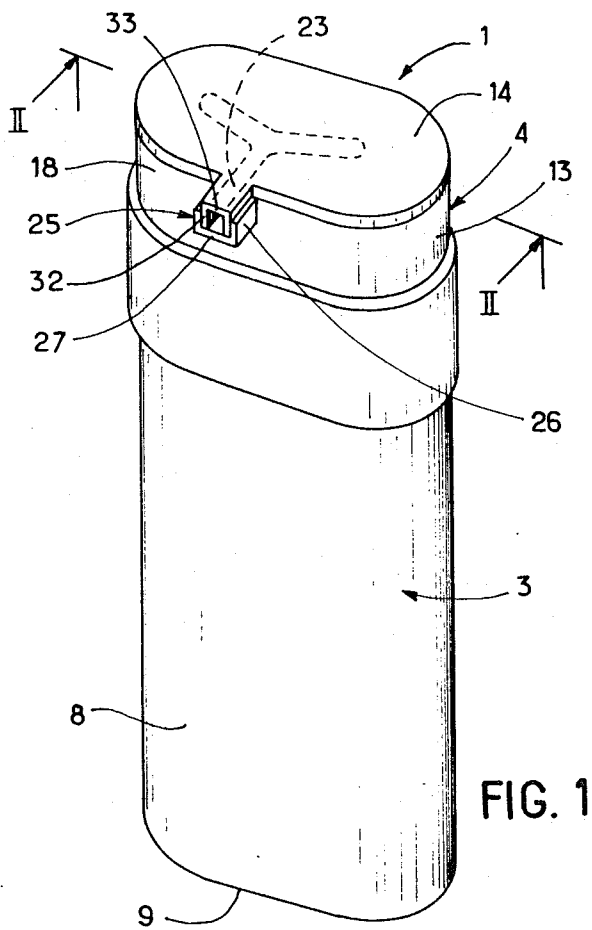
FIG. 1 is a view in perspective of a unit according to a first mode of embodiment for the dispensing of doses of a product resulting from the mixing in a mixer and dispenser head of two different constituents, each contained in a pressurised container of the "aerosol can" type.

If reference is now made to FIGS. 1 and 2, it will be seen that 1 designates a unit allowing a final product to be dispensed which results from the mixing of two individual constituents coming from two pressurised reservoirs 2*a* and 2*b*. These two reservoirs 2*a* and 2*b* are accommodated in a common shell 3 from which their upper end portions project. A dispenser and mixer head 4 is fitted on the sub-assembly constituted by the shell 3 and the reservoirs 2*a* and 2*b* accommodated therein.

Each reservoir 2*a* and 2*b* comprises a body 5*a*, 5*b* having a cylindrical lateral wall at its upper end with a valve carrier cup 6*a*, 6*b* being fixed thereto by means of a crimped rim. In the central zone of the valve carrier cup 6*a*, 6*b*, is disposed a valve 7 which is provided with an emergent outlet tube 7*a*, 7*b*. If the outlet tube 7*a*, or 7*b* is depressed, the contents of the reservoir are ejected under the effect of pressurised propellant gas present in the reservoir.

The shell 3 is obtained by the moulding of a relatively rigid plastics material. It comprises a cylindrical lateral wall 8 joined to a bottom 9 whose shape allows the two reservoirs 2*a* and 2*b* to be accommodated side-by-side. The shell 3 comprises an internal shaping on either side of its median plane to define together with the wall 8, an at least part cylindrical housing receiving a respective one of the reservoirs 2*a* and 2*b*; the bottom of the reservoirs then resting on the bottom 9 of the shell 3. The height of the lateral wall 8 is equal to the distance separating the bottom of a reservoir 2*a*, 2*b* from the upper edge of the valve carrier cup 6*a*, 6*b*. Moreover, the bottom 9 of the shell 3 comprises two openings 12*a*, 12*b* disposed in the axis of each one of the housings. These openings 12*a*, 12*b* allow access to each one of the reservoirs 2*a*, 2*b* to push them back with a view to extracting them when empty from their housing and when one wishes to replace them by another pair of reservoirs forming a refill.

The dispenser and mixer head 4 consists of two parts 13, 14, these two parts 13 and 14 each being obtained by the moulding of a relatively rigid plastics material. The first part 13, which is fitted directly on the ends of the two reservoirs 2*a*, 2*b* preferably is opaque, the second part 14 constituting a transparent lid.

The first part 13 comprises a relatively thick base plate 15 delimited, when the said part 13 is considered in its fitted position on the containers 2*a*, 2*b*, by a bottom wall 16, a top wall 17 and a lateral wall 18 whose contour is identical in shape and dimension with that of the lateral wall 8 of the shell 3. To the base of the plate 15, there is joined a peripheral skirt 19 whose internal wall is aligned with the lateral wall 18 and which is adapted slidingly to receive the upper end of the shell 3, the head 4 thus being mounted for sliding movement in relation to the said shell 3.

The bottom wall 16 has two small cylindrical recesses 20*a*, 20*b* with their axes perpendicular to the said bottom wall 16; these recesses are positioned in such a way that when the head 4 is in position on the shell 3 accommodating the two containers 2*a*, 2*b*, the upper ends of the valve stems 7*a*, 7*b* are received in the respective recesses 20*a*, 20*b* and come to bear against the bottom delimiting these latter. Moreover, the plate 15 is traversed by two ejection ducts 21*a*, 21*b*, perpendicular to the walls 16 and 17, the ducts 21*a*, 21*b* issuing in the bottom wall delimiting the recesses 20*a* and 20*b*.

In the top wall 17, a channel-shaped groove 22 is cut which is Y-shaped when viewed in plan, and whose median arm 23 (similar to the arm 123 which can be seen in FIG. 4) is disposed perpendicular to the rectilinear edge of the plate 15 to which is opens. The two lateral arms (similar to the lateral arms 123*a* and 123*b* which may be seen in FIG. 4), extend beyond the locations at which the corresponding ejection duct 21*a*, and 21*b* respectively, open. Moreover, the arm 23 of the groove 22 is extended to project beyond the peripheral edge of the plate 15 by a spout 25 constituted by two sides 26 joined to a bottom 27.

Near the top wall 17, the lateral wall 18 of the plate 15 has a peripheral rebate 28 which provides a peripheral bearing surface or shoulder; the upper edge of the sides 26 of the spout 25 is situated in the plane of the said bearing surface.

The lid 14 of the dispenser head 4 is constituted by a thin plate 29 which has the same shape as the plate 15 and which is provided with a peripheral rim 30 intended to come to be placed in the peripheral space provided by the rebate 28.

The plate 29 comprises, moreover, a rib 31 which delineates in relief a Y-shaped channel and which in the fitted position of parts 13 and 14 of the head 4, is placed against the lateral wall delimiting the groove 22 of the part 13, its free edge bearing against the bottom delimiting this groove 22.

The elements opposite the rib 31 which delimit the median arm of the said rib, are extended externally by two sides 32 which are joined to a top 33 which is situated in the extension spout of the plate 29.

When the two parts 13, 14 are fitted to each other, the rim 30 of the part 14 comes to bear on the peripheral bearing surface defined by the rebate 28, and the groove 22, as well as the spout 25, receive the rib 31 and its extension 32, 33 so that within the head 4, there is constituted a Y-shaped chamber 34 into which there issue the ducts 21*a*, 21*b* and which opens towards the outside in a projecting spout 27, 32, 33. This chamber 34 allows the individual constituents to be fed via its lateral arms to be mixed by its median arm.

When the user wishes to dispense a dose of the product, he causes the head 4, which has been assembled as indicated above, to slide above the shell 3 wherein the reservoirs 2*a* and 2*b* are disposed, until the valve stems 7*a*, 7*b* come to be accommodated in the respective recesses 20*a*, 20*b* of the part 13 of the head 4. The skirt 19 then surrounds the upper portion of the shell 3. Thereafter the user presses on the upper portion of the head 4 to cause the stems 7*a* and 7*b* to be lowered to come to bear against the bottom of the recesses 20*a*, 20*b*, which causes the associated valves to be opened and the two constituents to be ejected via the stems 7*a*, 7*b* respectively, and then via the ducts 21*a*, 21*b*, into the chamber 34. After the two individual flows have come together, the mixing of these two flows is obtained in the median arm of the said chamber 34, before the combined product is ejected via the spout 27, 32, 33.

After the product does has been dispensed, it is very easy to clean the dispenser head 4. It is simple to separate the two parts 13 and 14, which are merely nested, in order to clean them. This cleaning operation is easily effected, since there is easy access to the zones soiled by the product.

Figures 3, 4, 5, 6:
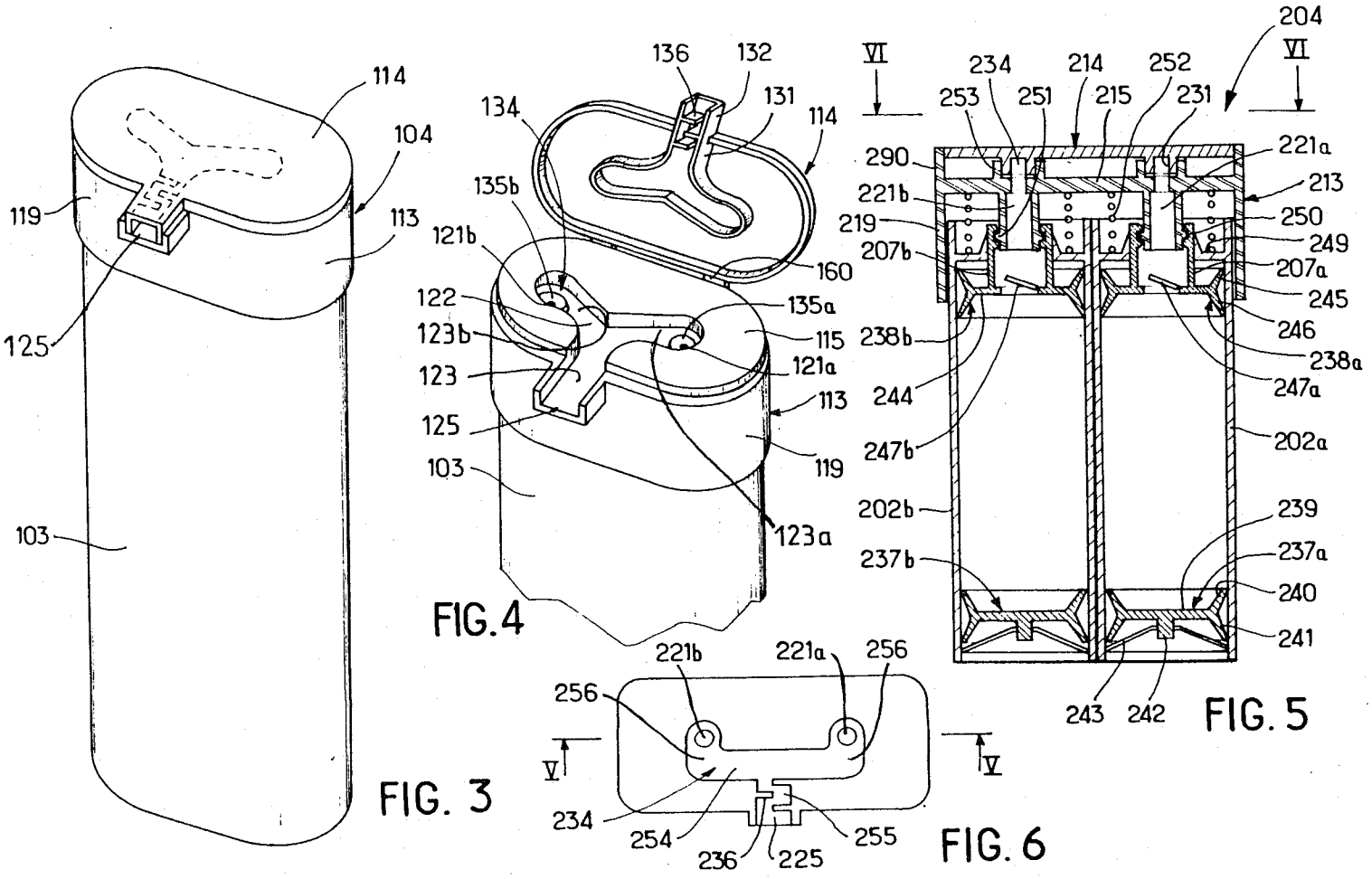
FIG. 3 is a view similar to FIG. 1 showing a second embodiment of the invention.
FIG. 4 is a view in perspective of the upper portion of the unit of FIG. 3 showing the dispenser and mixer head in the open position.
FIG. 5 is a cross-sectional view, along V—V of FIG. 6 of a unit according to another embodiment of the invention, the individual constituents being each stored in a reservoir equipped in its upper portion with a non-return valve and in its lower portion with a follower piston.
FIG. 6 is a top view of the unit of FIG. 5, assuming the upper portion of the dispenser head to have been removed.

A variant of the embodiment of the unit of FIGS. 1 and 2 has been represented in FIGS. 3 and 4. The elements of this second variant which are similar to those of the first mode of embodiment have been marked by reference numerals increased by 100 in relation to those used to designate the corresponding elements of the first mode of embodiment.

The shell 103 and the reservoirs which it contains are identical with the shell 3 and the reservoirs 2*a* and 2*b*. The dispenser head 104 differs from the head 4 in that the skirt 119 is located directly as an extension of the lateral wall 118 of the plate 115 and in that the parts 113 and 114 are joined to each other by an integral film hinge 160 disposed on the rectilinear edge of the plate 115 which is on the opposite side to that carrying the projecting dispenser spout. The bottom of the groove 122 cut in the upper portion of the plate 115 comprises protuberances 135*a*, 135*b* at the centre whereof there issue ejection ducts 121*a*, 121*b*. The two walls opposite the rectilinear arm of the rib 131 and the sides 132 extending it comprise deflectors 136 which are perpendicular to the axis of the said rectilinear arm, of the same height as the said rib 131, and which are carried alternately by one, and then the other of the said walls; these deflectors are three in number in this exemplary embodiment. Thus there is constituted a zigzag course over the outlet path to promote better mixing of the final product.

It should be noted that the head 104 can be made without difficulty in a single piece by moulding a plastic material; this reduces the cost of manufacture. The advantages of the embodiment of FIGS. 1 and 2 are moreover found again in this variant.

In FIGS. 5 and 6, another embodiment is illustrated and in which the reservoirs 202*a* and 202*b* are piston dispensers of the conventional type.

Each reservoir 202*a*, 202*b* is constituted by a cylindrical body wherein there are slidably mounted at one first end a follower piston 237*a*, 237*b* and at a second end an actuating piston 238*a*, 238*b*, the substance to be dispensed being disposed between the two pistons.

Each follower piston 237*a*, 237*b* comprises a base plate 239 comprising peripheral sealing lips 240 and 241 and provided externally with a central stud 242 to which non return blades 243 are fixed.

Each actuating piston 238*a*, 238*b* is constituted by a base plate 244 comprising peripheral sealing lips 245 and 246; the base plate 244 has at its centre a non return valve 247*a*, 247*b* and it carries externally an axial tube 207*a*, 207*b* which surrounds the associated non return valve; this axial tube passes through an annular flange 249 perpendicular to the lateral wall of the body of the reservoir and disposed near the free edge of the latter.

Each tube 207*a*, 207*b* comprises internally near its free edge an annular groove 250 which cooperates with an external peripheral catch engagement ring 251 formed on a tube carried by the plate 215 of the part 213 of the dispenser head 204. This tube delimits the ejection duct 221*a*, 221*b* which passes through the plate 215 to open in the same way as in the preceding embodiments to a mixing chamber 234. Between the plate 215 and each one of the flanges 249, there are disposed helical compression springs 252.

The dispenser head 204 is therefore constituted by a first part 213 formed by the above-mentioned plate 215 which is of an oblong shape, folded at right angles at its periphery to constitute a skirt 219 surrounding the upper ends of reservoirs 202*a*, 202*b*. The plate 215 has, on its upper side, a peripheral rim 290 extending the said skirt 219. As has already been indicated, the plate 215 is traversed by tubes delimiting ejection ducts 221*a*, 221*b*; it carries externally a continuous rib 253 (FIG. 5) having the shape of a flattened channel, to the web 254 (FIG. 6) whereof, there is joined a perpendicular median arm 255 situated on the side opposite to the lateral sides 256 of the said channel; the side 255 is extended towards the outside of the plate 215 in the same way as in the first two embodiments so as to constitute a spout 225 whose function will be indicated below.

The rib 253 constitutes together with the upper face of the plate 215, the equivalent of the grooves 22 or 122 of the two embodiments described above. This groove therefore receives a rib 231 similar to the ribs 31 and 131 of the two preceding embodiments: this rib 231 is carried by the lower face of the part 214 of the dispenser head 204. The part 214 is constituted by a thin plate not comprising any peripheral rims.

It will also be observed in FIG. 6 that provision has been made, in the spout 225, for deflectors 236 similar to the deflectors 136, but which are carried by the part 213 and not by the part 214. The deflectors facilitate the mixing of the individual constituents from the separate reservoirs 202*a* and 202*b*.

In the fitted position of the dispenser head 204 on the reservoirs 202*a* and 202*b*, the skirt 219 surrounds the upper portion of the bodies of the reservoirs 202*a*, 202*b*. The springs 252 are at rest.

When the user wishes to dispense a product dose with this unit, he proceeds as in the case of the preceding embodiments. Pressing on the part 214, he causes the actuating pistons 238*a* and 238*b* compressing the springs 252, and thus causes a dose of the two constituents of the product to be dispensed to penetrate into the tubes 207*a*, 207*b* and into the ducts 221*a*, 221*b*. When the pressure is relieved, the springs 252 restore the actuating pistons 238*a*, 238*b* into their initial position and the follower pistons 237*a*, 237*b* rise up again by a corresponding distance; simultaneously, the valves 247*a*, 247*b* are closed and the follower pistons are drawn up the reservoirs to replace the volume of product dispensed.

The cleaning of the parts 213 and 214 making up the dispenser head 204 is just as easy as in the case of the preceding embodiments.

I claim:

1. A head for dispensing doses of a product of a pasty or viscous consistency resulting from the mixing in the head of two constituents stored in separate side-by-side reservoirs each provided with a dispensing outlet element, said head being comprised of a first and a second part fitted to each other, said first part having a pair of ejection ducts passing therethrough and being provided with means adapted to cooperate simultaneously with the two dispensing outlet elements for causing the ejection of the contents of the reservoirs into respective ones of said ejection ducts, said first and second parts having complementary means carried thereby to cooperate to define a mixing chamber in the assembled position of the two parts, said ejection ducts opening into said mixing chamber at spaced locations, and said mixing chamber having a single outlet opening for the dispensing of a mixture of material admitted to the chamber from the two ducts, said first and second parts having mutually facing respective walls integral with said respective part, one of said walls having a continuous rib carried thereon extending substantially perpendicular therefrom and the other of said walls having a groove formed therein of a shape complementing the external contour of said rib, said mixing chamber being located between said walls and said rib being received in said groove with said rib having a height from said respective wall such that said rib defines the side walls of said mixing chamber when said first and second parts are assembled.

2. A dispenser head according to claim 1, wherein the mixing chamber is Y shaped having a pair of lateral ducts and a median duct, the locations at which the said ejection ducts open into the said chamber each being disposed near the end of a respective one of the lateral ducts, and the outlet from said chamber being provided via the median duct.

3. A dispenser head according to claim 1, including an integral hinge by means of which said first and second parts are articulated one to the other.

4. A dispenser head according to claim 1, wherein the outlet end of the chamber comprises a dispenser spout projecting from one side of the head.

5. A dispenser head according to claim 1 wherein the two constituents are stored in two reservoirs comprising a subassembly and said first part comprises a peripheral guidance skirt capable of sliding engagement with said sub-assembly.

6. A dispenser head according to claim 1, wherein at least one of said complementary means includes means defining a sinuous or zigzag path for the flow resulting from the mixing of the flows of the two individual constituents between the meeting point of these flows in the chamber and the outlet opening of the said chamber.

7. A dispenser head according to claim 6, wherein said means defining a sinuous or zigzag path comprises at least one deflector carried by at least one of said first and second parts.

8. A dispenser head according to claim 1, wherein the mixing chamber is provided with symetrical paths for the two flows from the respective ejection ducts to the meeting point of such flows in the chamber.

9. A dispenser head according to claim 8, wherein the mixing chamber has a channel shape communicating at one side at the ends thereof to said ducts and having at the mid-point of the opposite side a median outlet section opening to the exterior of the head.

10. A dispenser head in accordance with claim 1 in combination with a storage unit sub-assembly comprising said two separate side-by-side reservoirs each containing a product of a pasty or viscous consistency, said dispenser head and sub-assembly combination forming a dispenser unit with the dispenser head cooperating with said sub-assembly.

11. A dispenser head according to claim 10, wherein the reservoirs are containers provided with a manual ejection pump.

12. A dispenser head according to claim 11, wherein the reservoirs are piston dispensers each having an upper piston with a non-return valve, and in its lower portion, a follower piston, the upper pistons each having a tube which cooperate with the respective ejection ducts, the tubes and the ducts comprising complementary catch engagement retaining means for retaining the tubes and ejection ducts in mutual engagement.

13. A dispenser head according to claim 10, wherein the reservoirs are two pressurised containers of the "aerosol can" type provided with respective valves.

14. A dispenser head according to claim 13, wherein the sub-assembly comprises a common shell accommodating the two reservoirs, the valves having emergent stems, and the first part of the head comprises two recesses receiving the ends of said stems, said recesses communicating with the ejection ducts.

* * * * *